US006316875B1

(12) United States Patent
Kirkpatrick et al.

(10) Patent No.: US 6,316,875 B1
(45) Date of Patent: Nov. 13, 2001

(54) ELECTRODED SELENIUM LAMP

(75) Inventors: Douglas A. Kirkpatrick, Great Falls, VA (US); Bruce Shanks; Donald A. MacLennan, both of Gaithersburg, MD (US)

(73) Assignee: Fusion Lighting, Inc., Rockville, MD (US)

( * ) Notice: Subject to any disclaimer, the term of this patent is extended or adjusted under 35 U.S.C. 154(b) by 0 days.

(21) Appl. No.: 09/380,831

(22) PCT Filed: Sep. 24, 1998

(86) PCT No.: PCT/US98/18177

§ 371 Date: Sep. 10, 1999

§ 102(e) Date: Sep. 10, 1999

(87) PCT Pub. No.: WO99/16100

PCT Pub. Date: Apr. 1, 1999

Related U.S. Application Data

(60) Provisional application No. 60/059,968, filed on Sep. 25, 1997.

(51) Int. Cl.[7] ..... H01J 17/04; H01J 61/04

(52) U.S. Cl. ..... 313/633; 313/631; 313/634; 313/570; 313/574

(58) Field of Search ..... 313/633, 637, 313/638, 634, 570, 574, 631

(56) References Cited

U.S. PATENT DOCUMENTS

| | | | | |
|---|---|---|---|---|
| 3,234,421 | | 2/1966 | Reiling | 313/25 |
| 3,621,322 | | 11/1971 | Rehmet et al. | 313/184 |
| 4,864,191 | * | 9/1989 | Van De Weijer et al. | 313/633 |
| 4,950,954 | * | 8/1990 | Passmore et al. | 313/633 |
| 5,212,424 | | 5/1993 | Russell et al. | 313/562 |
| 5,404,076 | * | 4/1995 | Dolan et al. | 313/638 X |
| 5,504,392 | | 4/1996 | Natour et al. | 313/570 |
| 5,757,130 | * | 5/1998 | Dolan et al. | 313/633 X |
| 5,773,918 | | 6/1998 | Dolan et al. | 313/113 |

FOREIGN PATENT DOCUMENTS

| | | | |
|---|---|---|---|
| 0732719 | 9/1996 | (EP) | H01J/1/02 |
| 92/08240 | 5/1992 | (WO) | H01J/61/18 |

OTHER PUBLICATIONS

Patent Abstracts of Japan: JP 58080260 dated May 14, 1983.

* cited by examiner

*Primary Examiner*—Ashok Patel
(74) *Attorney, Agent, or Firm*—Paul E. Steiner

(57) ABSTRACT

An arc discharge lamp includes a light transmissive envelope (3), two electrodes (1, 2) disposed at least partially inside the light transmissive envelope, and a plasma forming fill which includes selenium when excited disposed inside the light transmissive envelope (3). The exterior surfaces of the part of the electrodes (1, 2) disposed inside the light transmissive envelope (3) comprise an electrode material selected from the group of molybdenum and molybdenum compounds.

29 Claims, 3 Drawing Sheets

ELECTRODED SELENIUM LAMP

CROSS REFERENCE TO RELATED APPLICATIONS

This application is based on and claims the benefit of priority of U.S. provisional application No. 60/059,968, filed Sep. 25, 1997.

BACKGROUND

1. Field of the Invention

The present invention pertains to selenium lamps. More particularly, the invention relates to electroded lamps containing a fill including selenium or selenium compounds.

2. Related Art

An example of an electroded lamp with a selenium fill is disclosed in U.S. Pat. No. 5,606,220, entitled VISIBLE LAMP INCLUDING SELENIUM OR SULFUR, and PCT Publication No. WO 92/08240, each of which is hereby incorporated by reference in its entirety.

The lifetime of an electroded lamp depends in substantial part on the useful life of its electrodes. During operation, the electrode material reacts with the fill material and may decompose. Also, due to high electrode temperatures, some electrode material may evaporate and become deposited on the lamp walls, thereby blackening the walls. If too much electrode material evaporates, the lamp may fail to operate at all.

These problems are particularly relevant to electroded lamps with a selenium fill because of the reactive nature of selenium at typical lamp operating conditions. An electroded selenium lamp using conventional electrode materials may have an extremely limited operating lifetime.

SUMMARY

It is an object of the invention to provide an electroded selenium lamp with an improved operating lifetime.

It is a further object of the invention to provide an electroded selenium lamp with an improved electrode material.

The above and other objects of the invention are achieved by an electroded selenium lamp having electrodes which use an electrode material that chemically participates in the discharge as it heats up. For example, the electrode material may include a metal which when combined with selenium exhibits a characteristic wherein any solid compound of the electrode material and selenium decomposes at suitable lamp operating temperatures to release the solid metal and a selenium gas. An exemplary electrode material meeting these requirements is molybdenum.

An electroded selenium lamp according to the invention includes a light transmissive discharge envelope enclosing a fill which produces light when excited, and two electrodes, each electrode having a portion thereof disposed inside the light transmissive discharge envelope, wherein the two electrodes each include molybdenum or a molybdenum compound. The light transmissive discharge envelope may be, for example, a quartz arc tube made from, for example, clear fused quartz. Other examples for the arc tube material include alumina or sapphire. The fill may include, for example, selenium or selenium compounds. The selenium may, for example, be initially deposited on the electrodes when the electrodes are cool, wherein the selenium is driven off the electrodes to join the light producing fill as the electrodes are heated during operation. The fill may further include cesium halide (e.g. CsBr or CsI), and may additionally include an amount of halide in excess of stoichiometry.

If cesium is present in the fill in a quartz arc tube, a halide must also be present to prevent the cesium from attacking the quartz. Alternatively, the arc tube may be made from alumina or sapphire because cesium does not attack these materials.

The electroded selenium lamp may further include a light transmissive outer envelope surrounding the light transmissive discharge envelope. The light transmissive outer envelope is preferably evacuated to provide a vacuum around the light transmissive discharge envelope.

Another aspect of the invention provides an additive to the fill which facilitates a halogen cycle for thermal redeposition on the electrodes.

BRIEF DESCRIPTION OF THE DRAWINGS

The invention will be better understood with reference to the drawings, wherein.

DESCRIPTION

Selenium lamps may be either electrodeless or electroded. The above-referenced U.S. Pat. No. 5,606,220 describes both types. In comparison with electrodeless selenium lamps, the electroded selenium lamp according to the invention may be operated at direct current (DC) or low frequency (e.g. less than about 40 kHz) alternating current (AC) drive voltages, thereby significantly reducing the cost and complexity of the drive circuitry.

The electroded selenium lamp according to the invention may be operated with lower density selenium fills (e.g. about $10^{17}$ to $10^{18}$ molecules/cc or lower), in which case the light spectrum produced from the selenium is predominantly in the ultra-violet (UV) light range. Preferably, however, the electroded lamp according the invention is operated with higher density selenium fills (e.g. about $10^{18}$ to $10^{19}$ molecules/cc or higher) so that the light spectrum produced from the selenium is predominantly in the visible light range. At the above-mentioned selenium fill densities, the discharge typically takes the form of an arc. Electrodes in the presence of an arc discharge attain very high temperatures during operation. The high electrode temperature dramatically increases the electrodes chemical reactivity to any species in the discharge gas. Because selenium is highly reactive with most metals, conventional electrode materials are not suitable for a long-life, electroded selenium lamp.

According to the invention, molybdenum (or molybdenum compounds) is used as the electrode material exposed to the interior of the bulb volume. The use of the material molybdenum for other purposes is well known in the electroded lamp art. Conventional electrode materials include tungsten or tungsten in combination with another metal.

Conventionally, molybdenum is used as a quartz-to-metal seal material because molybdenum is a less brittle metal in comparison to tungsten. Such quartz/moly-foil seals are standard in the lamp industry Molybdenum would not ordinarily be thought of as an electrode material because it is softer than tungsten and has a lower melting point than tungsten. In combination with a selenium lamp, however, molybdenum presents advantages not available with conventional electrode materials. These advantages are hereinafter discussed in detail.

Figure 1:
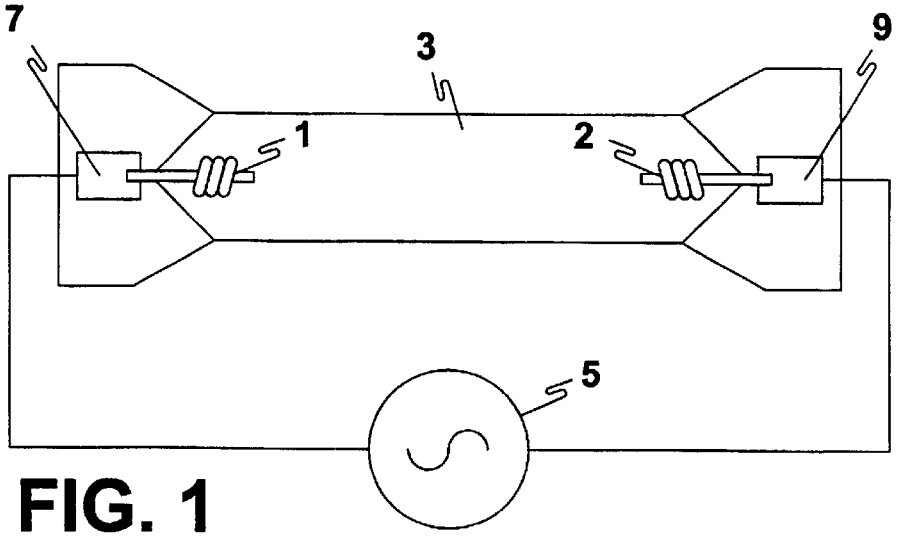
FIG. 1 is a schematic view of a first embodiment of an electroded selenium lamp according to the invention.

FIG. 1 is a schematic view of a first embodiment of an electroded selenium lamp according to the invention. An electroded arc discharge lamp includes electrodes 1 and 2 which are mounted at respective ends of an arc tube 3. A voltage source 5 provides energy to the electrodes 1, 2 for initiating and sustaining an arc discharge within the arc tube 3 between the electrodes 1, 2. The connection between the electrodes 1, 2 and the voltage source 5 may be made, for example, via molybdenum foil seals 7, 9 using conventional quartz/molybdenum sealing methods. According to the invention, all exterior surfaces of the electrodes 1, 2 which are exposed to the interior volume of the arc tube 3 are made from molybdenum or molybdenum compounds.

Figure 2:
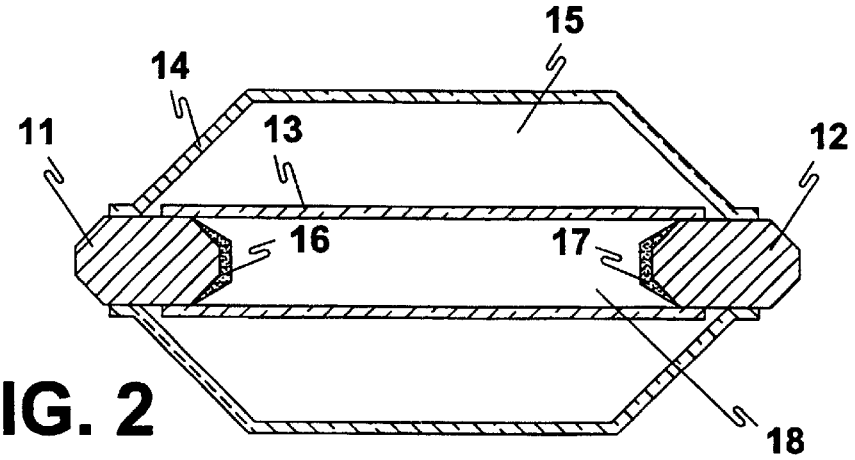
FIG. 2 is a schematic, cross sectional view of a second embodiment of an electroded selenium lamp according to the invention.

FIG. 2 shows a schematic diagram of a second embodiment of an electroded selenium lamp according to the invention. Molybdenum electrodes 11 and 12 are mounted at respective ends of an arc tube 13, which may be made, for example, from clear fused quartz, alumina, or sapphire. The arc tube 13 is mounted within an evacuated outer envelope 14 made of, for example, hard glass. An area 15 preferably forms a vacuum between the outer envelope 14 and the arc tube 13.

The molybdenum electrodes 11, 12 are formed such that surfaces 16, 17, which are exposed to the volume interior to the arc tube 13, have been converted to one or a combination of the selenide species (e.g. $Mo_3Se_4$, $MoSe_2$, Se). This can be accomplished, for example, by dipping the molybdenum electrodes 11, 12 in molten selenium at a temperature between about 221° C. and 685° C. Alternatively, the electrodes 11, 12 can be converted after the arc tube 13 is sealed by doping the arc tube 13 with a suitable amount of selenium and heating the lamp in a furnace to a temperature of about 700° C.

The arc tube 13 encloses a fill 18 which, for example, includes a low pressure inert gas. During operation, the selenium is driven off of the electrodes 11, 12 and joins the fill 18. During operation, the fill 18, including selenium or selenium compounds, forms an arc discharge between the two electrodes 11,12 which, at suitable operating temperatures and pressures, produces visible light.

When operation ceases, it may be desirable for the selenium in the fill 18 to redeposit on the electrodes 11, 12. This is accomplished by configuring the electrodes 11, 12 to cool faster than the arc tube 13. For example, the outer envelope 14 thermally isolates the arc tube 13 from the surrounding air to a greater extent than the electrodes 11, 12 are isolated from the surrounding air. Thus, the electrodes 11, 12 cool faster than the arc tube 13. If the electrodes 11, 12 cool below the condensation point of selenium (e.g. about 685° C.) before the arc tube 13, the selenium condenses on the electrodes 11, 12 when the lamp is extinguished. Preferably, the area of the electrodes 11, 12 exposed outside of the arc tube 13 is relatively large to aid in cooling.

While the above-discussed embodiment specifies that the electrodes are formed of molybdenum compounds already including selenium, other approaches would bring similar results. For example, another approach includes simply coating the electrodes 11, 12 with an appropriate amount of selenium to provide the proper density of selenium for the discharge. Another alternative is to dose the arc tube 13 with the appropriate amount of selenium and allow an initial inert gas discharge to evaporate the selenium. In either alternative, when operation ceases the selenium will condense on the electrodes in the form of various selenides (e.g. $Mo_3Se_4$, $MoSe_2$, Se) as described above.

Figure 3:
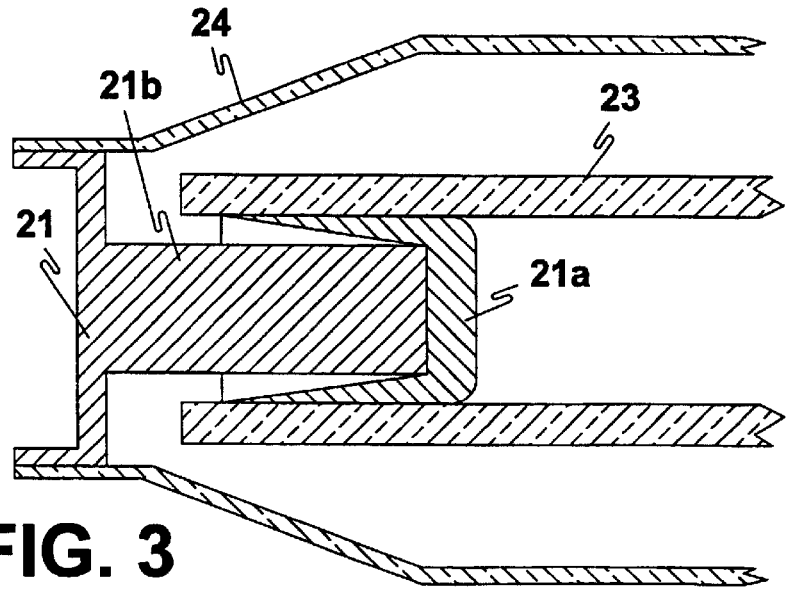
FIG. 3 is an expanded, fragmented cross sectional of an electrode geometry for a third embodiment of an electroded selenium lamp according to the invention.

FIG. 3 shows a third embodiment of the invention with a more detailed electrode structure. Mounting molybdenum to quartz is well known in the art and is described in further detail in the Handbook of Electron Tube and Vacuum Techniques written by Fred Rosebury, Addison-Wesley Publishing Company, 1965, which is hereby incorporated by reference in its entirety. An exemplary approach according to the invention for mounting an electrode 21 to a quartz arc tube 23 includes a "housekeeper" seal as discussed in the above-referenced handbook.

As shown in FIG. 3, an electrode 21 include a molybdenum portion 21*a* and a non-molybdenum portion 21*b*. The non-molybdenum portion 21*b* may be for example, a metal or other conductive material. The quartz arc tube 23 is mounted to the molybdenum portion 21*a* of the electrode 21 by means of the above-discussed "housekeeper" seal. The non-molybdenum portion 21*b* of the electrode 21 is mounted to a quartz outer envelope 24 by means of other conventional methods for mounting metals to quartz.

Figure 4:
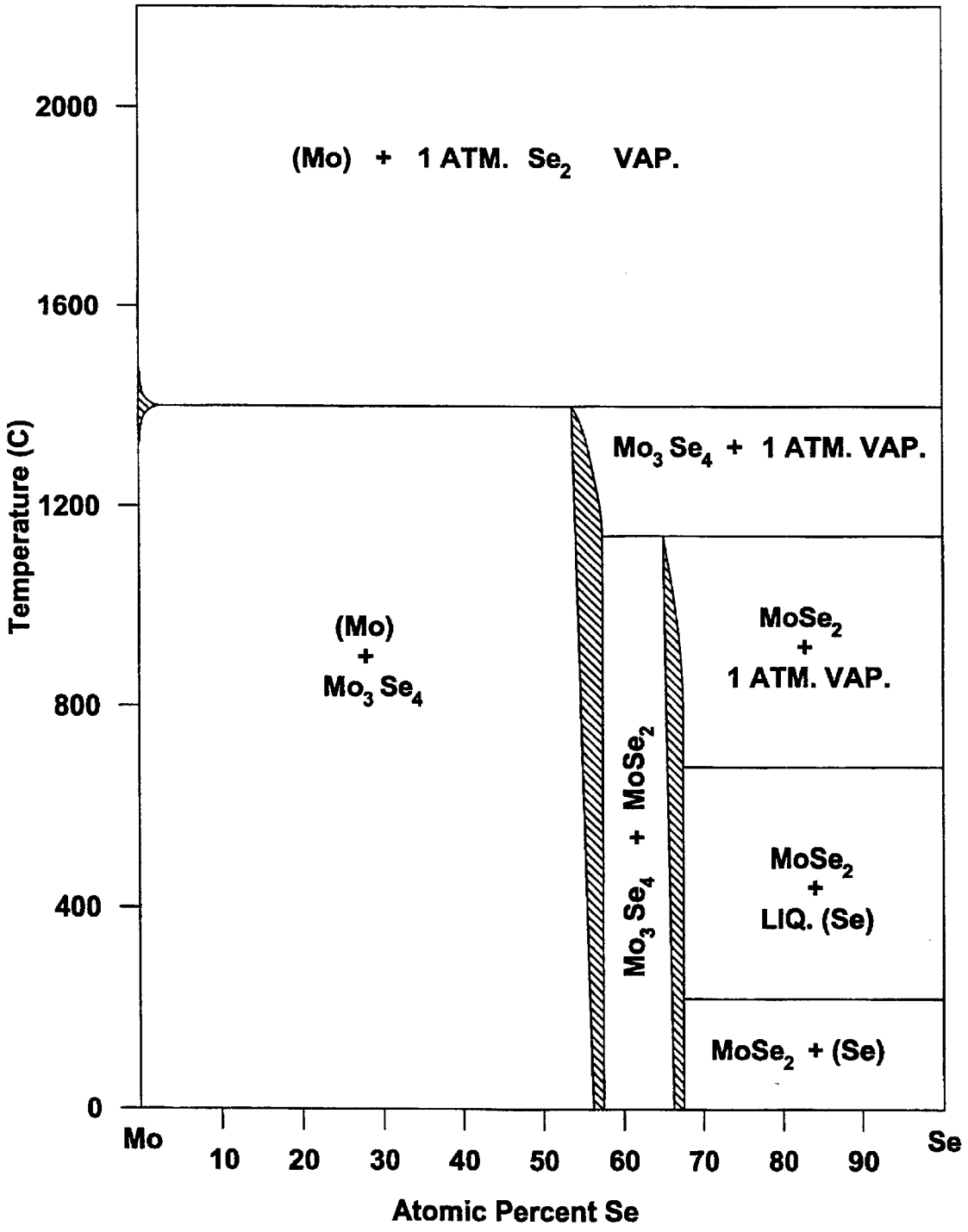
FIG. 4 is an equilibrium phase diagram for molybdenum and selenium.

A more detailed discussion of the operation of the electroded selenium lamp according to the invention is hereinafter made with reference to FIG. 4. FIG. 4 shows an equilibrium phase diagram for molybdenum and selenium. Further description regarding the characteristics of molybdenum and molybdenum/selenium compounds can be found in "Molybdenum: Physico-Chemical Properties of its Compounds and Alloys," Brewer, L. and Lamoreaux, R. H., ATOMIC ENERGY REV. SPEC. ISSUE No. 7, Vienna, 1980, which is hereby incorporated by reference in its entirety. The diagram shown in FIG. 4 is calculated from estimated thermodynamic data in the Brewer reference. The Mo content of Se vapor, liquid, and solid is extremely small, and fixed by oxide or halide impurities. Other work cited in the Brewer reference indicates that at high pressures of Se vapor, used to prevent dissociation, $Mo_3Se_4$ and $MoSe_2$ melt congruently, 1600° C. to 1700° C., with $Mo/Mo_3Se_4$ and $Mo_3Se_4$ / $MoSe_2$ eutectics formed.

The melting point of molybdenum is about 2896° K. According to the invention, an electrode made from molybdenum (or at least including molybdenum as the portion of the electrode exposed to the interior volume of the arc tube) operates such that it cycles through the selenium dissociation when driving an arc discharge lamp. As discussed above, arc electrodes typically run very hot (e.g. in the vicinity of 2000° C.). Thus, at operating electrode temperatures, selenium will be driven off the electrodes. When the discharge is extinguished, if the electrodes are configured as discussed above, the selenium will redeposit on the molybdenum electrodes.

The equilibrium phase diagram for Mo—Se is noteworthy because it shows that any solid compound of molybdenum and selenium decomposes at above about 1400° C. (+/−100° C.) to release the pure molybdenum metal and a selenium gas. As temperature increases, chemical reactivities also increase. For most conventional electrode materials, however, dissociation would only occur after the electrode material was also a gas (i.e. after both components have become a gas). Thus the molybdenum/selenium combination provides advantages for an electrode material in a selenium lamp because the molybdenum remains a solid at a point where the selenium vaporizes. Also, as can be seen from FIG. 4, the molybdenum and selenium do not react at typical electrode operating temperatures (e.g. about 2000° C.).

Another aspect of the invention involves recovering molybdenum which finds its way into the discharge or onto the quartz arc tube wall. In the emission process, it is likely that some molybdenum will enter the discharge region (e.g. by evaporation or sputtering) and may become deposited on the arc tube wall. According to the invention, a small amount of chlorine is added to the lamp fill to recover molybdenum from the fill and/or lamp wall. The addition of chlorine to the fill results in a "halogen" cycle, as discussed below.

Figure 5:
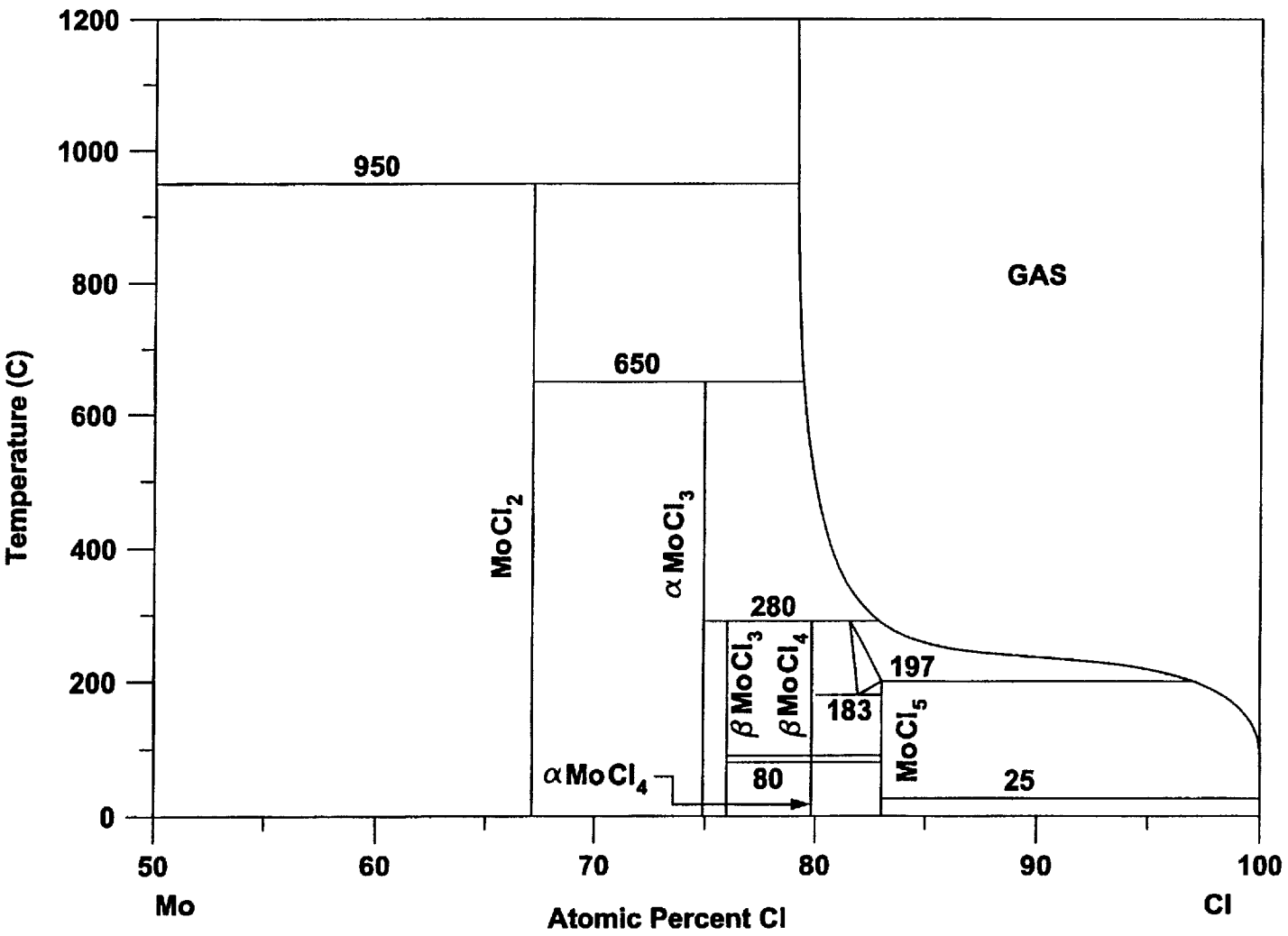
FIG. 5 is an equilibrium phase diagram for molybdenum and chlorine.

FIG. 5 shows an equilibrium phase diagram for molybdenum and chlorine.

Molybdenum Chloride ($MoCl_2$) decomposes at about 950° C. If the arc tube wall is held below about 950° C., and the electrode surface is above about 950° C. (about 2000° C. is the likely electrode surface temperature), then any molybdenum depositing on the arc tube wall will combine with the chlorine in the fill to form $MoCl_2$ in the fill (i.e. the molybdenum is removed from the arc tube wall). The $MoCl_2$ in the fill will eventually contact the electrode surface, at which point the chlorine will dissociate and the molybdenum will be returned to the electrode. Thus, any molybdenum leaving the electrode surface will be preferentially transported back to the electrode. This function can also be served by other halogens including, for example, iodine and bromine. Both $MoI_2$ and $MoBr_2$ have similar thermodynamic functionality as $MOCl_2$.

The use of chlorine in the fill does not create any problems with respect to the formation of selenium-chlorine compounds and their vapor pressures. The only selenium compound with chlorine is selenium tetrachloride ($SeCl_4$). Selenium tetrachloride melts at about 305° C., but decomposes at 288° C. (i.e. before it melts). The same holds true for selenium-bromide and selenium-iodide which have even lower melting points and decomposition temperatures.

More information regarding the illustrated and other compounds may be had by referring to *Thermodynamic Data for Inorganic Sulfides, Selenides and Tellurides*, K. Mills, London: Butterworths, 1974, *Materials Thermochemistry*, 6th Ed., O.

Kubaschewski, et al., Oxford: Pergamon Press, 1993, *JANAF Thermochem. Tables*, 3rd Ed. J. Phys. Chem. Ref. Data, M. Chase, et al., 1985 (Supp. 1), each of which is hereby incorporated by reference in its entirety.

In order to prevent or at least reduce the amount of sputtering (injecting of molybdenum into the discharge), the molybdenum electrodes may be doped with an appropriate substance, such as cesium, barium oxide, strontium oxide, and/or thorium in the form of a dispenser cathode. The addition of cesium to the fill provides further advantages because the cesium modifies the discharge as an electron donor. A number of the positive effects of adding cesium to the fill are described in detail in U.S. Provisional Patent Application Serial No. 60/047,351, filed May 21, 1997, entitled SULFUR/SELENIUM LAMPS WITHOUT BULB ROTATION, and PCT Application No. PCT/US98/10327, each of which is herein incorporated by reference in its entirety. Cesium also aids the electrode by lowering the electrode work function.

While the invention has been described with respect to specific embodiments, the invention is not to be construed as being limited to the examples set forth herein. The various embodiments described above should be as illustrative and not limiting. For example, while molybdenum has been described as a suitable electrode material according to the invention, other electrode materials with similar qualities in combination with selenium may also be used.

What is claimed is:

1. An arc discharge lamp, comprising:

a sealed arc tube having respective ends;

a pair of electrodes respectively mounted at the respective ends of the arc tube with at least a portion of the electrodes extending inside the arc tube; and a plasma forming fill which includes selenium when excited disposed inside the arc tube, wherein an exterior surface of the portion of the electrodes extending inside the arc tube comprises a metal electrode material which reacts with selenium to form a solid compound of the electrode material and selenium, and wherein the solid compound decomposes at the lamp operating temperature to release the solid metal material and a selenium gas.

2. An arc discharge lamp, comprising:

a sealed arc tube having respective ends;

a pair of electrodes respectively mounted at the respective ends of the arc tube with at least a portion of the electrodes extending inside the arc tube; and a plasma forming fill which includes selenium when excited disposed inside the arc tube, wherein an exterior surface of the portion of the electrodes extending inside the arc tube comprises molybdenum.

3. The lamp as recited in claim 2, wherein the metal electrode material comprises a molybdenum compound.

4. The lamp as recited in claim 2, wherein the exterior surfaces which are exposed to the volume interior to the arc tube have been converted to at least one of the selenide species.

5. The lamp as recited in claim 2, wherein selenium is deposited on the electrodes.

6. The lamp as recited in claim 2, further comprising a cesium halide disposed in the arc tube.

7. The lamp as recited in claim 6, wherein the halide is present in an amount in excess of stoichiometry.

8. The lamp as recited in claim 2, further comprising a light transmissive outer envelope surrounding the arc tube.

9. The lamp as recited in claim 8, wherein the light transmissive outer envelope is evacuated to provide a vacuum around the arc tube.

10. The lamp as recited in claim 2, further comprising an additive in the fill which facilitates a halogen cycle for thermal redeposition of the metal electrode material on the electrodes.

11. The lamp as recited in claim 2, wherein upon extinguishing the selenium preferentially deposits on the electrodes.

12. The lamp as recited in claim 11, wherein the electrodes are configured to cool faster than the arc tube.

13. The lamp as recited in claim 12, further comprising an outer envelope surrounding the arc tube which thermally isolates the arc tube from the surrounding air to a greater extent than the electrodes are isolated from the surrounding air.

14. The lamp as recited in claim 13, wherein an area of the electrodes exposed outside of the arc tube is relatively large to aid in cooling.

15. The lamp as recited in claim 2, wherein the portion of the electrodes extending inside the arc tube electrodes comprises a molybdenum portion and wherein the electrodes further comprise a non-molybdenum portion external to the arc tube.

16. The lamp as recited in claim 15, wherein the molybdenum portion is connected to the arc tube via a housekeeper seal.

17. The lamp as recited in claim 16, further comprising an outer envelope surrounding the arc tube and connected to the non-molybdenum portion of the electrodes.

18. The lamp as recited in claim 2, further comprising a voltage source connected to the electrodes for exciting the fill.

19. An arc discharge lamp, comprising:

a light transmissive envelope;

two electrodes disposed at least partially inside the light transmissive envelope; and a plasma forming fill which includes selenium when excited disposed inside the light transmissive envelope, wherein an exterior surface of the portions of the electrodes disposed inside the light transmissive envelope comprises an electrode material selected from the group of molybdenum and molybdenum compounds.

20. The lamp as recited in claim 19, wherein the light transmissive envelope is made from a material selected from the group of quartz, sapphire, and alumina.

21. The lamp as recited in claim 19, wherein the fill comprises a material selected from the group of elemental selenium and selenium compounds.

22. The lamp as recited in claim 19, wherein the selenium is deposited on the electrodes prior to lamp operation.

23. The lamp as recited in claim 19, wherein the fill further comprises a cesium halide.

24. The lamp as recited in claim 19, further comprising a light transmissive outer envelope surrounding the light transmissive envelope.

25. The lamp as recited in claim 19, further comprising an additive to the fill which facilitates a halogen cycle for thermal redeposition of molybdenum on the electrodes.

26. The lamp as recited in claim 19, wherein upon extinguishment the selenium preferentially deposits on the electrodes.

27. The lamp as recited in claim 26, wherein the electrodes are configured to cool faster than the light transmissive envelope.

28. The lamp as recited in claim 19, wherein the electrodes further comprise non-molybdenum portions.

29. The lamp as recited in claim 19, further comprising a voltage source connected to the electrodes for exciting the fill.

* * * * *